United States Patent [19]

Cordes

[11] 4,274,322

[45] Jun. 23, 1981

[54] DOUBLE HI-HAT SUPPORT BRACKETS

[76] Inventor: Charles P. Cordes, 27 Kenneth Pl., Clark, N.J. 07066

[21] Appl. No.: 83,711

[22] Filed: Oct. 11, 1979

[51] Int. Cl.[3] ..... G10G 5/00

[52] U.S. Cl. ..... 84/422 R

[58] Field of Search ..... 84/422

[56] References Cited

U.S. PATENT DOCUMENTS 4,111,095 9/1978 Simons ..... 84/422 H

FOREIGN PATENT DOCUMENTS 565460 11/1944 United Kingdom ..... 84/422 H

*Primary Examiner*—Lawrence R. Franklin

*Attorney, Agent, or Firm*—Sughrue, Rothwell, Mion, Zinn and Macpeak

[57] ABSTRACT

Two sets of cymbals are mounted on two pairs of horizontally extending arms respectively of a support bracket which in turn is adapted to be mounted adjacent the upper end of a conventional hi-hat support stand of the type having a foot pedal operated rod vertically reciprocable within a hollow tube. The lower arms which support the bottom cymbal of each set of cymbals are detachably clamped to the hollow tube and the upper arms which carry the upper cymbal of each set of cymbals are secured to the upper end of the vertically reciprocable rod and guided relative to the lower arms by means of a guide blade secured to the upper arms and complementary guides secured to the lower arms. A spring is connected between the guide blade and the complementary guides for normally biasing the upper arms away from the lower arms.

4 Claims, 7 Drawing Figures

FIG 1
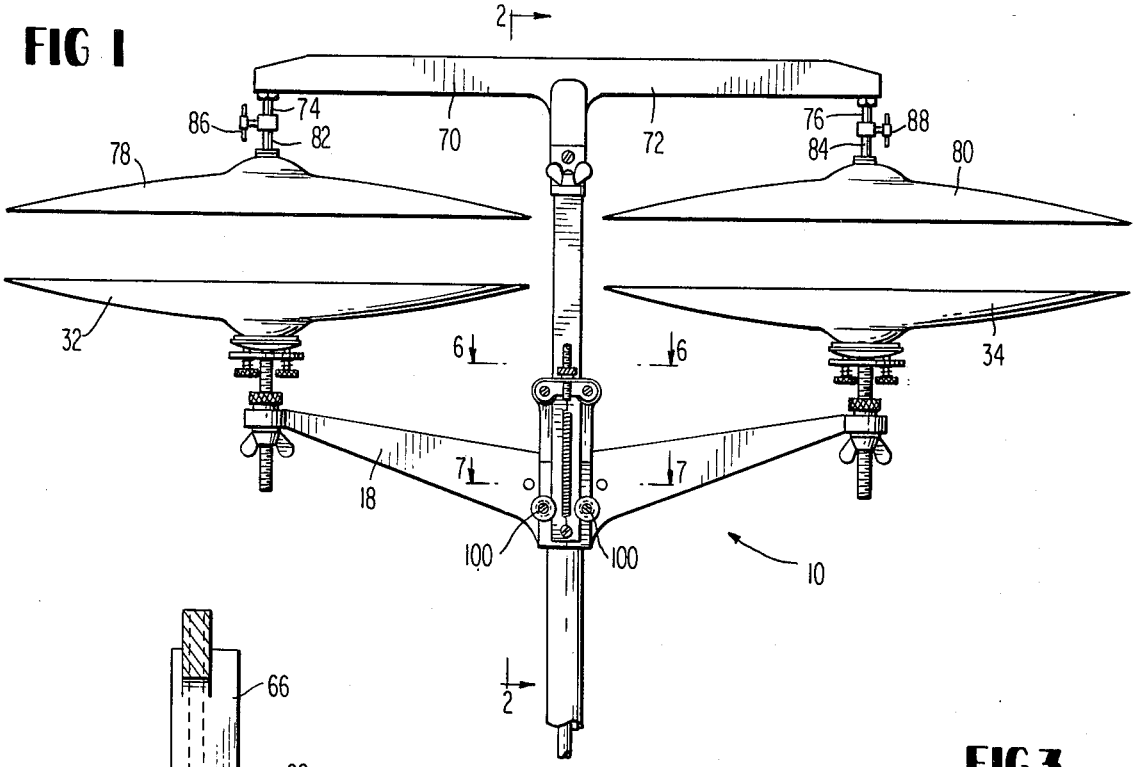
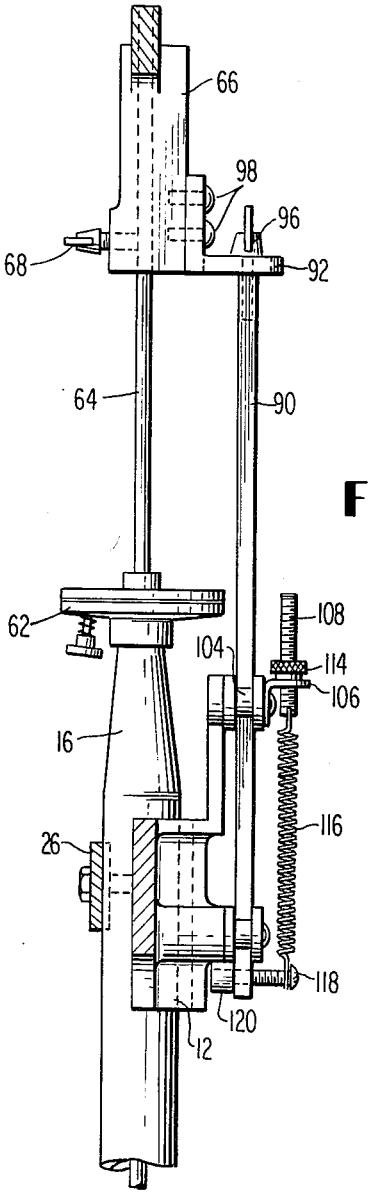
FIG 2
FIG 3
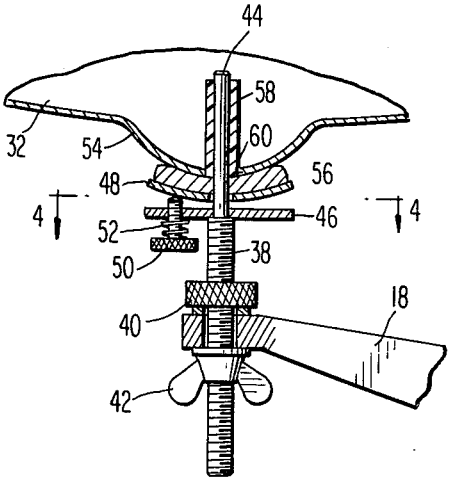
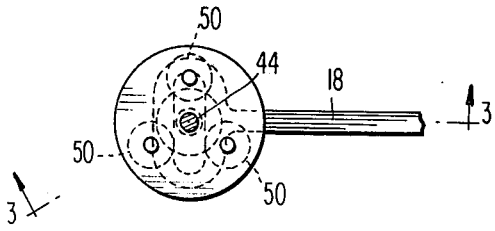
FIG 4

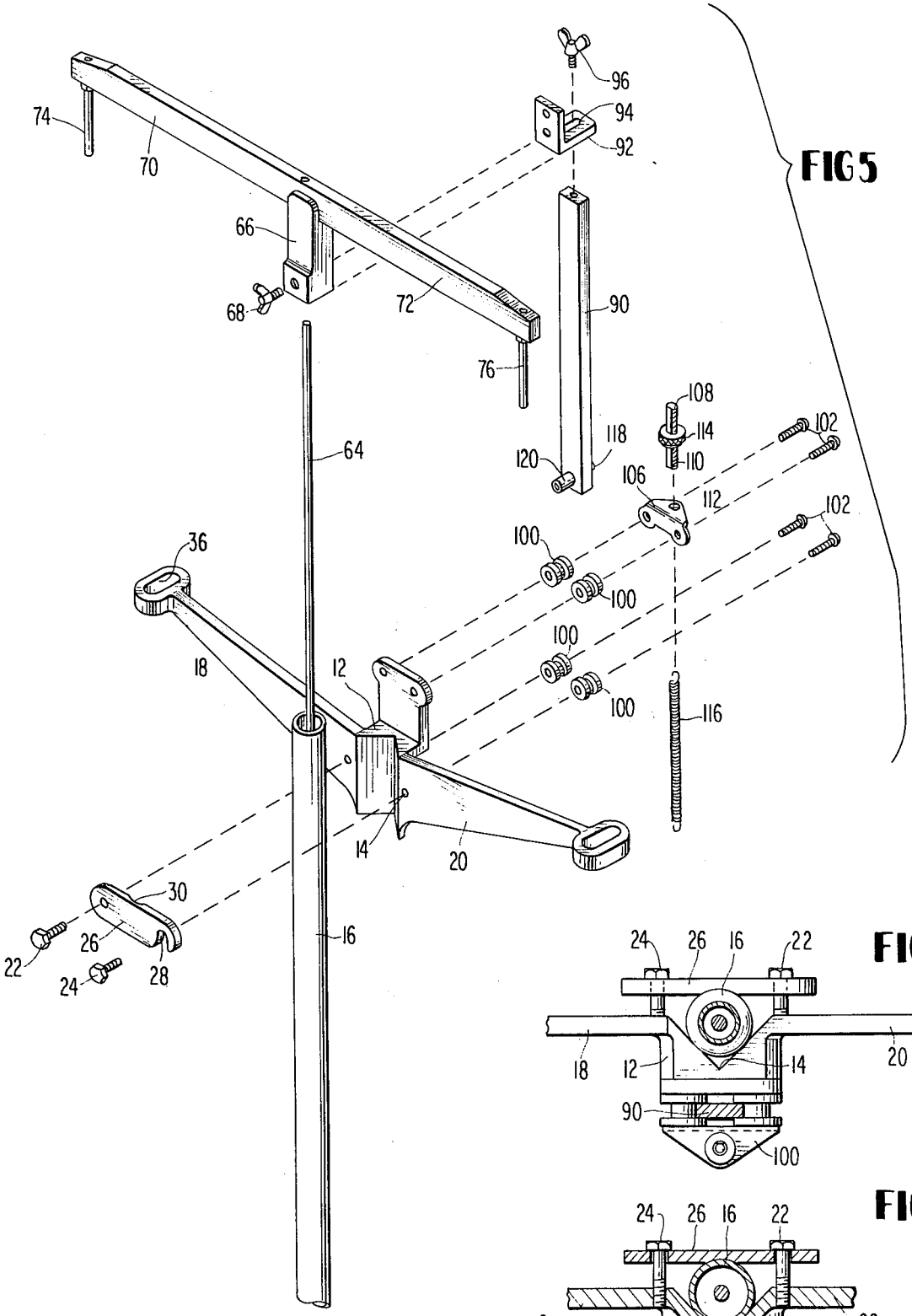
FIG 5
FIG 6
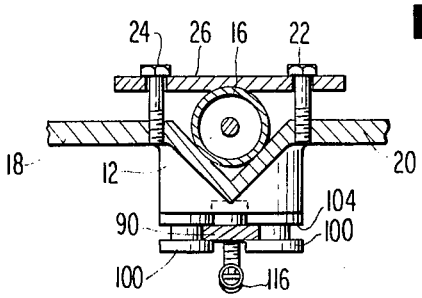
FIG 7

DOUBLE HI-HAT SUPPORT BRACKETS

BACKGROUND OF THE INVENTION

1. Field of the Invention

The present invention is directed to a cymbal support and more specifically to a double hi-hat support bracket.

2. Prior Art

A conventional hi-hat cymbal is a foot operated percussion musical instrument generally comprised of a vertically disposed tube having a rod vertically reciprocable therein. The tube is supported in the vertical position by means of a collapsable tripod and a spring biased foot pedal is operably connected to the rod for reciprocating the rod within the tube. A lower upwardly facing cymbal is loosely supported adjacent the upper end of the tube and an upper downwardly facing cymbal is loosely carried by the rod so that upon operation of the foot pedal the upper cymbal will be brought downwardly into engagement with the lower cymbal.

It has been proposed in the patent to Simons, U.S. Pat. No. 4,111,095 to provide a hi-hat arrangement using two sets of cymbals which are disposed coaxially with respect to each other. In order to accomplish this a complicated set of support arms are utilized for supporting the lower cymbal of the upper set above the lower set of cymbals. The coaxial arrangement of the two sets of cymbals makes it difficult to play from one set of cymbals to the other and the support bracket interferes with a number of standard playing procedures and also inhibits the use of different size cymbals.

SUMMARY OF THE INVENTION

The present invention provides a double hi-hat support bracket for supporting two sets of cymbals in spaced apart horizontal relation whereby standard playing techniques may readily be utilized with each set of cymbals, the size of one cymbal set may vary with respect to the size of the other cymbal set and the transfer of play from one set to the other may be facilitated.

The present invention provides a double hi-hat support bracket which can be used to convert any existing single hi-hat arrangement to a double hi-hat arrangement.

The present invention provides a new and improved double hi-hat support bracket comprising clamping means adapted to clamp the bracket to any size support tube, a pair of horizontal arms secured to and extending outwardly from said clamping means in opposite directions, and attaching brackets adapted to be secured to the upper end of a rod vertically reciprocable within said tube, a pair of horizontally extending arms extending outwardly from said attachment bracket in opposite directions, guide means for maintaining said upper and lower arms in vertical alignment with each other comprising a guide blade secured to said attachment bracket and extending downwardly therefrom and complementary guide means secured to said clamping means for receiving and guiding said guide blade and spring means interconnected between said guide blades and said complementary guide means for normally biasing said upper arms upwardly away from said lower arms; said upper and lower arms each having means adjacent the outer ends thereof for supporting two cymbal sets.

The foregoing in other objects, features and advantages of the invention will be apparent from the following more particular description of a preferred embodiment of the invention as illustrated in the accompanying drawings.

BRIEF DESCRIPTION OF THE DRAWINGS

FIG. 1 is a front elevation view of the double hi-hat support bracket mounted on a conventional hi-hat support stand.

FIG. 2 is a sectional view taken along the line 2—2 in FIG. 1.

FIG. 3 is a partial sectional view of a cymbal on a lower cymbal support.

FIG. 4 is a sectional view taken along the line 4—4 in FIG. 3.

FIG. 5 is an exploded view of the double hi-hat support bracket according to the present invention.

FIG. 6 is a sectional view taken along the line 6—6 of FIG. 1.

FIG. 7 is a sectional view taken along the line 7—7 in FIG. 1.

DETAILED DESCRIPTION OF THE INVENTION

The double hi-hat support bracket 10 as shown in FIG. 1 may be manufactured and sold with its own support stand or may be used with any conventional single hi-hat support stand without any modifications. In order to accomplish this the bracket is provided with a clamp which is best shown in FIGS. 5–7. The clamp is comprised of a body 12 having a vertically extending v-shaped notch 14 in one face thereof which is adapted to engage the hollow tubular support stand 16. A pair of horizontally extending arms 18 and 20 extend outwardly from opposite sides of the body 12 and a pair of bolts 22 and 24 are threadedly secured into apertures in the arms 18 and 20 on opposite sides of the v-shaped notch 14. A latching plate 26 is pivoted on the bolt 22 and is provided with a recess 28 which is adapted to fit over the bolt 24 so as to clamp the bracket to the tube 16 upon tightening of the bolts 22 and 24. In order to prevent flattening of the tube 16 a shallow groove 30 is provided in the face of the latch plate 26 which engages the tube 16.

The lower cymbals 32 and 34 of the two cymbal sets are detachably connected to the outer ends of the arms 18 and 20 by identical connecting means. Therefore, only the connecting means with respect to the cymbal 32 will be described in detail. An elongated slot 36 is formed in the outer end of the arm 18 through which a threaded post 38 extends. The threaded post 38 is adjustably secured to the arm 18 by means of a knurled nut 40 above the end of the arm 18 and a wing nut 42 below the end of the arm 18. The threaded post 38 is provided with an unthreaded smaller diameter extension 44. A circular plate 46 is secured on the extension 44 by press fitting, welding or the like against the larger diameter threaded post 38. The cup-shaped steel washer 48 is loosely disposed on the extension 44 and is adjustably supported relative to the disk 46 by means of three equally spaced level screws 50 which are threaded through the disk 46. Each of the level screws is surrounded by means of a coil spring 52 to prevent movement of the screw relative to the disk due to vibrations. The bell-shaped portion 54 of the cymbal 32 is supported on the cup-shaped washer 48 by means of a felt washer 56. The felt washer 56 and the cup-shaped steel washer 48 are held in assembled relation relative to the disk 46 by means of a plastic sleeve 58 secured on the upper end of the extension 44. The outer diameter of the sleeve 58 is substantailly equal to or slightly less then the diameter of the hole 60 and the cymbal so that the cymbal can readily be slid onto or off of the plastic sleeve 58 and so that the cymbal will not directly contact the extension 44. By having three leveling screws 50 it is possible to level both lower cymbals relative to each other and to adjust the relationship of the lower cymbal relative to the top cymbal. The three leveling screws can be adjusted to achieve a slight tilt if desired. The conventional tilting mechanism 62 for a single hi-hat is shown on the upper end of the tube 16 in FIG. 2. In some conventional support stands the tilter 62 is integral therewith and cannot be removed when converting from a single hi-hat arrangement to a double hi-hat arrangement but the presence of the tilter will not in any way interfere with the operation of the double hi-hat arrangement according to the present invention as evidenced by the arrangement as shown in FIG. 2.

In the conventional support stand a spring-biased foot pedal operated rod 64 is vertically reciprocable within the tube 16 for supporting the upper cymbal. According to the present invention an attachment bracket 66 is provided having a vertically disposed bore therein for receiving the rod 64. The attachment bracket 66 may be secured to the rod 64 by means of a set screw 68. A pair of horizontally extending arms 70 and 72 extend outwardly from the attachment bracket 66 in opposite directions. A pair of support pins 74 and 76 are secured to and extend downwardly from the outer ends of the arms 70 and 72 respectively. A pair of upper cymbals 78 and 80 are loosely supported on the support rods 74 and 76 by means of conventional cymbal support 82 and 84 which are secured to support rods 74 and 76 by means of set screws 86 and 88 respectively.

Since the clamping means for the lower arms and the attaching means for the upper arms are rotatably adjustable relative to the tube 16 and the rod 64 respectively, it is necessary to provide guide means to maintain the vertical alignment of the upper arms 70 and 72 with respect to the lower arms 18 and 20. A guide blade 90 is adjustably secured to a bracket 92 having an elongated slot 94 by means of a bolt 96. The bracket 92 is secured to the attaching bracket 66 by any suitable means such as screws 98. Four plastic guide sleeves 100 are secured to the body 12 of the clamping means by screws 102 and each sleeve 100 is provided with a circumferential groove 104 in which the guide blade 90 is slidably disposed.

While the conventional hi-hat stand has a spring for normally biasing the rod 64 upwardly relative to the tube 16 the added weight of a double hi-hat arrangement might require an additional spring force to bias the rod 64 upwardly and maintain the necessary gap between the upper and lower cymbals. In order to provide this additional spring force, a bracket 106 is secured to the body 12 by means of the two uppermost screws 100 which secure the two uppermost guide sleeves 100 to the body 12. A threaded post 108 having a transverse bore 110 adjacent the lower end thereof is adjustably mounted in an aperture 112 in the bracket 106 by means of a knurled nut 114. The upper end of a coiled tension spring 116 is connected to the bore 110 in the threaded post 108 and the lower end of the spring 116 is connected to a bolt 118 which is threaded through the lower end of the guide blade 90. A plastic bumper 120 is secured to the end of the bolt 118 and bears against a portion of the body 12 to limit the upward movement of the guide blade 90 relative to the body 12.

As evident from the above description of the present invention, the single hi-hat can quickly be converted to a double hi-hat by simply removing the single set of cymbals from the tube and rod and attaching the lower and upper arms of the present bracket to the tube and rod respectively by means of the clamping arrangement associated with the lower arms and the attachment means associated with the upper arms. The spring 116 will help the spring associated with the foot pedal of the conventional hi-hat stand with the added weight of two sets of cymbals and a guide blade 90 and guides 100 will prevent the upper arms from rotating relative to the lower arms about the axis of the stand. The lower cymbals are provided with an up or down adjustment to accommodate cymbals with varying cup or bell sizes to be independently adjusted and the top cymbals are adjustable up and down by a conventional cymbal clutch on the rods 74 and 76. The elongated slots 36 in the ends of the arms 18 and 20 provide additional adjustment for the location of the lower cymbals relative to the upper cymbals. The three leveling screws in the lower cymbal support disk are also utilized to adjust the vertical height and the tilt of the lower cymbals. The tilter mismatches the cymbals slightly to prevent air lock which sometimes results in no sound at all. There is no supporting structure to interfere with the playing of the two sets of cymbals and the location of the two sets of cymbals side by side fits easily into the established horizontal flow of a drummer when playing a set. The support bracket according to the present invention permits the use of any size set of cymbals on either the left or right-hand side as viewed in FIG. 1. Finally, the use of the V-shaped notch 14 in the clamping arrangement for the lower arms enables the bracket to be mounted on any size standard tubing thereby enhancing the versatility of the double hi-hat support mechanism.

While the invention has been particularly shown and described with reference to a preferred embodiment thereof will be understood by those in the art that various changes in form and details may be made therein without departing from the spirit and scope of the invention.

What is claimed is:

1. A double hi-hat support bracket comprising upper bracket means having first attachment means for securing said upper bracket means to the upper end of the vertically reciprocable rod of a conventional hi-hat support, a pair of horizontal upper arms attached to and extending outwardly from opposite sides of said first attachment means and support means on the outer end of each arm for supporting the upper cymbal of a cymbal set on each upper arm, lower bracket means having second attachment means for securing said lower bracket means to the upper end of the hollow tube of a standard hi-hat support, a pair of horizontal lower arms attached to and extending outwardly from opposite sides of said second attachment means and support means on the outer end of each lower arm for supporting the lower cymbal of a cymbal set on each lower arm, spring means connected between said upper and lower bracket means for normally maintaining said upper bracket means in spaced relation to said lower bracket means, and complementary guide means on said upper and lower bracket means for guiding said upper bracket means for vertical reciprocatory movement relative to said lower bracket means and for maintaining said upper arms in substantially vertical alignment with said lower arms, said guide means being comprised of a flat elongated guide blade secured to and extending downwardly from said upper bracket means and at least one pair of low friction guide members secured to said lower bracket means engaging said blade to prevent all lateral movement of said blade and rotary movement of said blade about the longitudinal axis thereof.

2. A double hi-hat support bracket as set forth in claim 1 wherein said low friction guide members are comprised of a plurality of plastic guide sleeves having circumferential grooves therein opposed to each other in which said blade is movable.

3. The double hi-hat support bracket as set forth in claim 1 wherein said second attachment means is comprised of a body having a vertically disposed V-shaped notch engageable with one side of said tube and a releaseable clamping means secured to said body and engageable with the opposite side of said tube.

4. A double hi-hat support bracket as set forth in claim 1 wherein said support means on the outer end of each lower arm is comprised of an elongated slot in the end of said lower arm, pin means having a threaded portion extending through said slot, nut means engageable with said threaded portion for adjustably securing said pin means in said slot, a plate secured to said pin means adjacent the upper end of said threaded portion, an upwardly open concave washer mounted on said pin means above said plate, felt means on the concave surface of said washer upon which the lower cymbal of a cymbal set is adapted to rest, a plastic sleeve on the upper end of said pin means to prevent said cymbal from contacting said pin means and three equally spaced adjusting screws threaded through said plate into contact with said washer for adjusting the height and tilt of said washer and accordingly the height and tilt of a cymbal resting thereon.

* * * * *